US007332693B2

(12) United States Patent
Hamburger

(10) Patent No.: US 7,332,693 B2
(45) Date of Patent: Feb. 19, 2008

(54) TUBE AND METHOD FOR BRACING FUNCTIONAL ELEMENTS IN THE SAME

(75) Inventor: Andreas Hamburger, Germersheim (DE)

(73) Assignees: Eichenauer Heizelemente GmbH & Co. KG, Kandel (DE); Beru AG, Ludwigsburg (DE)

( * ) Notice: Subject to any disclaimer, the term of this patent is extended or adjusted under 35 U.S.C. 154(b) by 335 days.

(21) Appl. No.: 11/014,990

(22) Filed: Dec. 20, 2004

(65) Prior Publication Data

US 2005/0144896 A1 Jul. 7, 2005

(30) Foreign Application Priority Data

Dec. 20, 2003 (DE) ..... 103 60 159

(51) Int. Cl.
*H05B 3/06* (2006.01)

(52) U.S. Cl. ..... 219/520; 219/504; 219/530; 219/534; 219/537; 392/502

(58) Field of Classification Search ..... 219/202, 219/520, 537, 541, 544, 548, 553, 504, 505, 219/535, 534; 392/503, 497, 502; 338/226
See application file for complete search history.

(56) References Cited

U.S. PATENT DOCUMENTS 4,942,289 A * 7/1990 Roller et al. ..... 219/504
6,180,930 B1 * 1/2001 Wu ..... 219/530

FOREIGN PATENT DOCUMENTS

| | | |
|---|---|---|
| DE | 78 38 558 | 12/1978 |
| DE | 29 48 591 A1 | 12/1979 |
| DE | 85 03 272.7 | 6/1985 |
| DE | 39 42 266 C1 | 12/1989 |
| EP | 0 240 447 | 10/1987 |
| EP | 0 340 550 B1 | 7/1993 |
| EP | 0 333 906 B1 | 10/1993 |
| EP | 0 573 691 B1 | 12/1993 |

* cited by examiner

*Primary Examiner*—Tu Ba Hoang
*Assistant Examiner*—Leonid Fastovsky
(74) *Attorney, Agent, or Firm*—Antonelli, Terry, Stout & Kraus, LLP.

(57) ABSTRACT

Functional elements, particularly PTC heating elements, are braced in a hollow reception means, such as a profile tube. The reception means have two at least partly concave top wall areas facing one anther and flat sides of the functional elements and in this way permits a bracing of the functional elements, in that side walls of the reception means, extending substantially perpendicular to the concave top wall areas, are subject to the action of a pressing pressure. In the free space areas defined by the concave top walls can be fitted ends of attachment parts, such as metal lamellas, which are clamped in the same operation, according to the invention, during the bracing of the functional elements. This makes it possible in a simple manner to manufacture assembled devices, particularly electric heating devices.

18 Claims, 6 Drawing Sheets

TUBE AND METHOD FOR BRACING FUNCTIONAL ELEMENTS IN THE SAME

FIELD OF THE INVENTION

The invention relates to a method for bracing functional elements, particularly PTC heating elements, in a hollow reception means, particularly a tube or pipe. The invention also relates to a tube or pipe, particularly for receiving functional elements, such as PTC heating elements, as well as uses of such a tube or pipe.

BACKGROUND OF THE INVENTION

Electrical heating devices using resistance heating elements in the form of PTC elements for producing a heating power, are nowadays known in numerous fields of technology, e.g. in automotive engineering. In the latter said heating devices are e.g. used for heating vehicle interiors and this will apply for as long as alternative heating methods using engine cooling water as the heating medium do not operate efficiently due to an inadequate engine heating. The electrical heating device can be either separately constructed or can be integrated into a rib/tube block through which cooling water flows, in that e.g. part of the tubes through which the cooling water flows is replaced by PTC tubes. In the case of such heating devices regularly individual PTC elements are placed in hollow reception means, such as profile tubes, which are plastically deformed by pressurizing their top or cover walls for bracing the PTC elements. To this end and according to the prior art using a suitable tool a pressing pressure id exerted on the hollow reception means from two facing top walls, so that correspondingly an internal spacing of the top walls decreases until they engage with the PTC elements received in the reception means so as to secure the some. It is considered particularly disadvantageous that after relaxing or relieving the press used, the deformed top walls of the reception means necessarily spring back by a certain amount due to an existing partial elasticity, so that the retaining force for the PTC elements decreases. In addition, comparatively high pressing forces in an equivalent order of magnitude of 40 t are necessary for the plastic deformation of the reception means, which leads to a complex construction of the pressing tools to be used.

Moreover, said heating devices, in addition to the above-described heating tubes (reception means and PTC elements) regularly have heat emission ribs in the form of lamellas or the like, which are connected in good heat conducting manner to the heating tubes. In the case of the known heating devices or methods for their manufacture, the lamellas must be fitted in a following, additional process step, so that there are disadvantageously long manufacturing times and corresponding cost increases.

The problem of the invention is to give a method and a profiler tube with which it is possible to overcome the aforementioned disadvantages.

SUMMARY OF THE INVENTION

The problem is solved by a method for bracing functional elements, particularly PCT heating elements, in a hollow reception means, such as a tube, with two at least partly concave top wall areas facing one another and flat sides of the functional elements, the latter being braced by the pressurizing of the side walls extending substantially perpendicular to the concave top wall areas. This problem is also solved by a tube, particularly for receiving functional elements, such as PTC heating elements, with two at least partially concave top wall areas facing one another and flat sides of the functional elements, as well as further side walls extending substantially perpendicular to the concave top wall areas and which can be pressurized with a pressing pressure for reducing an internal spacing between the drawn in top wall areas.

The pressurizing or action of a compression force takes place substantially perpendicular to the flat sides of the functional elements and precisely perpendicular to the surface normal thereof on the further side walls, if the latter are planar, and precisely perpendicular to the flat aides of the functional elements, which is not necessary and then parallel to the surface normal of the further side walls. As a result of this pressure or force action the initially partly concavely preshaped top walls are pressed against the functional element, so that the latter is braced in the tube.

Thus, according to the invention, for bracing the reception means (tubes) only a limited pressing force i: necessary, because no plastic deformation has to be brought about in the pressing direction. Consequently the tools used are simply constructed.

According to a preferred development of the method, the side walls are pressurized substantially in the direction of their surface normal and the tube is preferably constructed in such a way that the side walls are pressurizable substantially in the direction of their surface normal. The statement that pressurization takes place substantially in the direction of the surface normal of the side walls in particular means that the forces exerting the pressurizing action have a preponderant or main component parallel to the surface normal of the side walls, even though the forces are not directed precisely parallel to the surface normal.

In connection with the method according to the invention, the bracing of the functional elements preferably takes place in such a way that as a result of pressurization an internal spacing between the facing top walls is reduced and regions of the concave top wall areas approach one another for clamping the functional elements. In an extremely preferred further development, as a result of the pressurization a spacing between portions of in each case at least one concave top wall area is reduced and between the latter at least one attachment part, such as a metal lamella or corrugated rib is permanently clamped. In this way it is possible to integrate the fixing of attachment parts in the pressing process.

According to a further development of the profile tube according to the invention, through the top walls of the drawn in top wall areas, prior to a pressurization there is a definition of an outwardly widening, free space area with a cross-section substantially corresponding to an isosceles trapezium. The free space area is preferably constructed for receiving at least one complimentary end area of at least one attachment part, such as a metal lamella or corrugated rib. In an extremely preferred development of the profile tube according to the invention, after pressurization, the attachment part is substantially positively embraced by the top walls of the concave top wall area and is in this way retained in clamping manner. Thus an assembled device, such an a heating device, manufactured using a profile tube according to the invention, with the aforementioned heat transfer ribs, can be manufactured in a single method step during the bracing of the PTC elements.

For the secure retention of the attachment parts, it is also possible, after pressurization has taken place, for the top walls of the drawn in top wall areas to define undercuts for receiving complimentary corner or angle areas of the attachment part. As a result of the limited pressing forces necessary, in a further restriction with respect to the prior art, there can be longitudinally ribbed profiles, which hitherto have been generally constructed in a complicated manner from two separate half-profiles. Thus, according to a further development of the profile tube according to the invention, in at least one of the top or side wall areas the latter has ribbed elements, which preferably have an extension component in the longitudinal direction of the profile tube. For optimum heat emission purposes, the ribbed elements can also have in cross-section an extension substantially perpendicular to a local path of the top and/or side wall areas or the top and/or side walls.

The above-described profile tubes are generally suitable for creating an assembled device from a plurality of profile tubes and attachment parts connecting the same, the attachment parts being held by the profile tubes and use preferably takes place in a heater having an arrangement of heat emission ribs.

BRIEF DESCRIPTION OF THE DRAWINGS

Further characteristics and advantages of the invention can be gathered from the following description of embodiments with reference to the attached drawings, wherein show.

DETAILED DESCRIPTION OF THE DRAWINGS

The invention is described hereinafter relative to a number of embodiments, which in particular relate to profile tubes for use in electric heaters. However, it is stressed that the method and profile tube according to the invention are not restricted to such applications and can instead be used wherever functional elements are to be braced in the interior of a hollow reception means.

Figure 1:
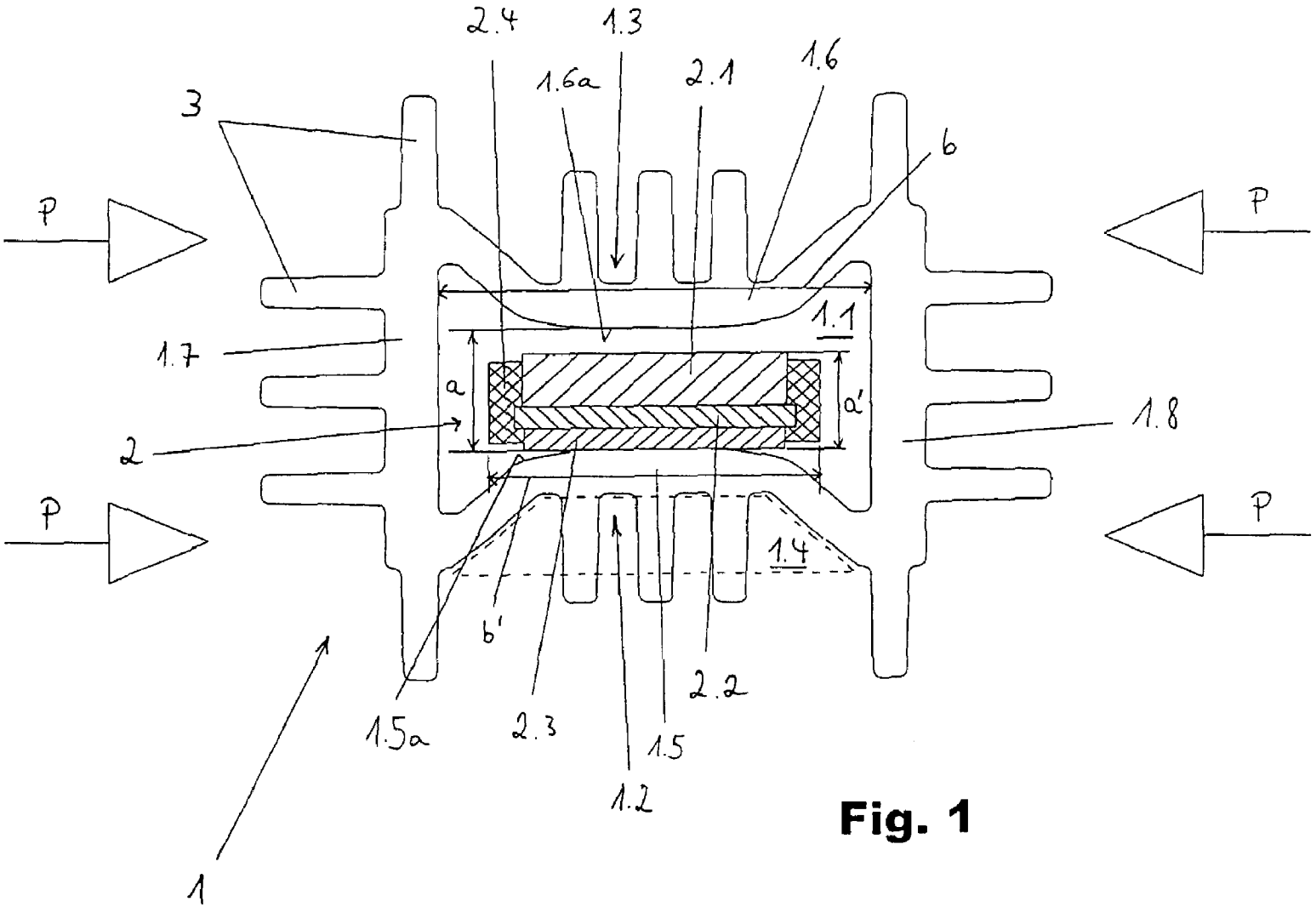
FIG. 1 A cross-section through a profile tube according to the invention with fitted PTC heating element, prior to pressing.

FIG. 1 shows an extruded profile tube 1 according to the invention having a substantially rectangular cross-section. In the interior 1.1 of profile tube 1 is located a flat PTC heating element 2 comprising a PTC resistor 2.1, a contact-strip 2.2, a ceramic insulation 2.3 and a contact frame 2.4. The PTC heating element 2 more particularly has flat sides 2*a*, 2*b*. The construction of such PTC elements 2 is known to the expert and as such does not form part of the subject matter of the invention.

The inventive profile tube 1 has cover or top wall areas 1.2, 1.3, which are drawn inwards facing a strictly rectangular cross-section of the profile tube 1, i.e. have a concave construction. Through the drawn in top wall areas 1.2, 1.3 of the profile tube 1 are defined outwardly widening, free space areas 1.4, whereof one is shown in exemplified, broken line form in FIG. 1. The top walls 1.5, 1.6 of the profile tube 1 have in the drawn in, concave top wall areas 1.2, 1.3 an internal spacing a, which is larger than a corresponding dimension a' between the flat sides 2*a*, 2*b* of the FTC element 2. The profile tube 1 has further side walls or side wall areas 1.7, 1.8 extending substantially perpendicular to the concave top wall areas 1.2, 1.3 and whose internal spacing b is larger than a corresponding dimension b' of PTC element 2, the following applying: (b-b')>(a-a').

In the embodiment of FIG. 1, along its outer contour, the inventive profile tube 1 has ribbed elements 3, which are directed perpendicular to the plane of the drawing, i.e. extend in the profile longitudinal direction and in cross-section are substantially perpendicular to a local extension direction of the top and side walls 1.5-1.8.

The bracing of the PTC element 2 in the interior 1.1 of the inventive profile tube 1 takes place by lateral pressure (arrow P) on side walls 1-7, 1.8. This will be explained in greater detail hereinafter relative to FIG. 3*a, b*.

Figure 2A:
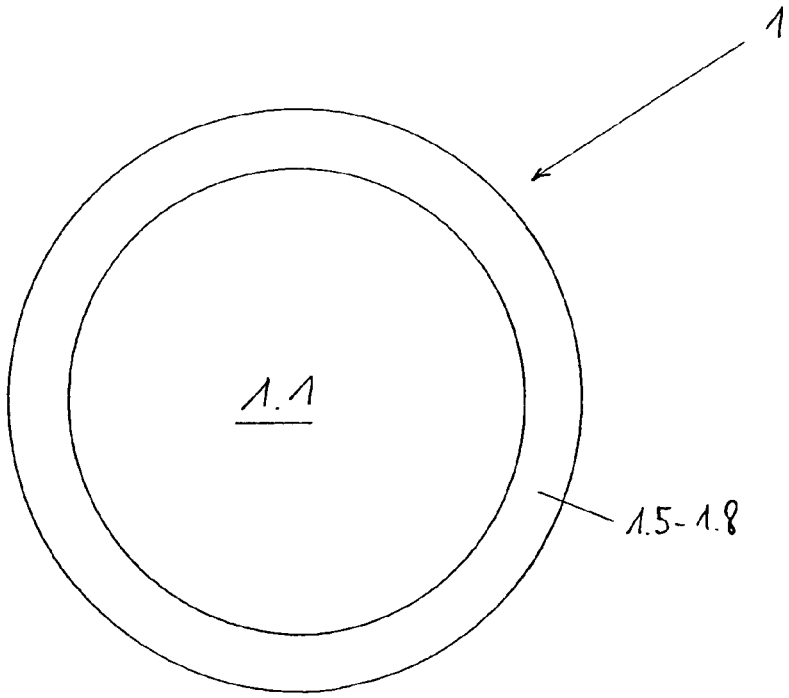
FIG. 2*a* Another possible cross-section of a profile tube according to the intention.
Figure 2B:
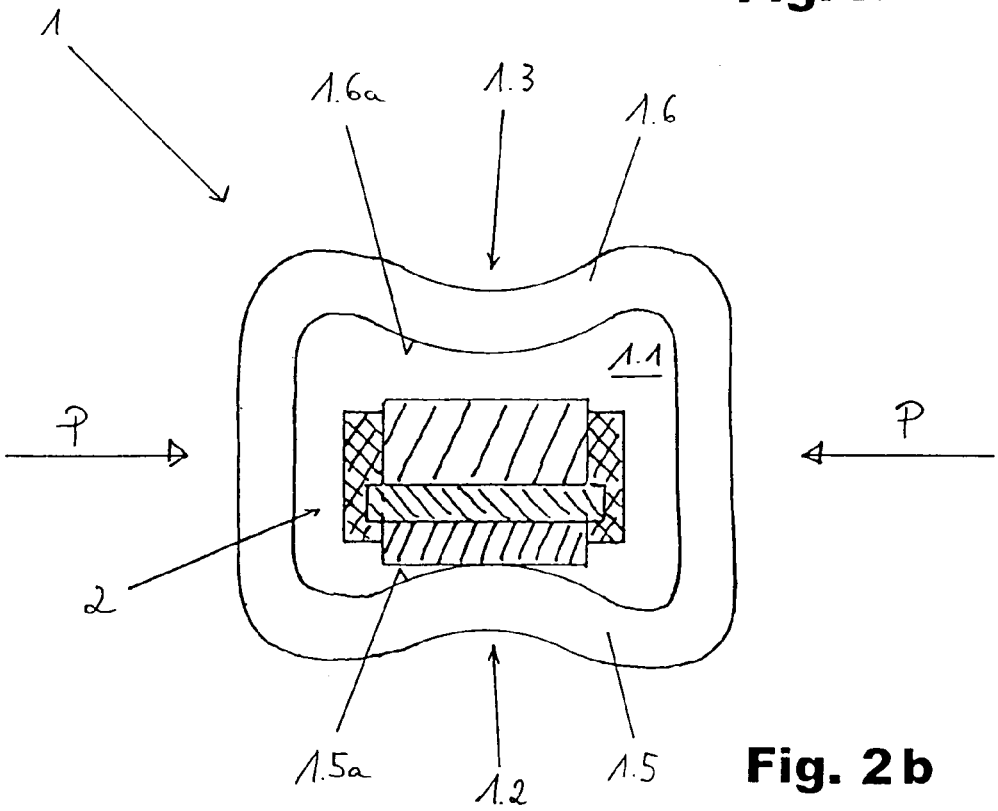
FIG. 2*b* Another cross-sectional view of the profile tube of FIG. 2*a* with drawn in top wall areas and fitted PTC element.

FIG. 2*a, b* show a further possible development of the inventive profile tube 1, here initially (FIG. 2*a*) as a seamless drawn or welded tube with a circular cross-section which, as shown in FIG. 2*b*, is to be profiled so as to form concave top wall areas 1.2, 1.3 (cf. FIG. 1), e.g. using a suitable, not shown roller system.

Figure 3A:
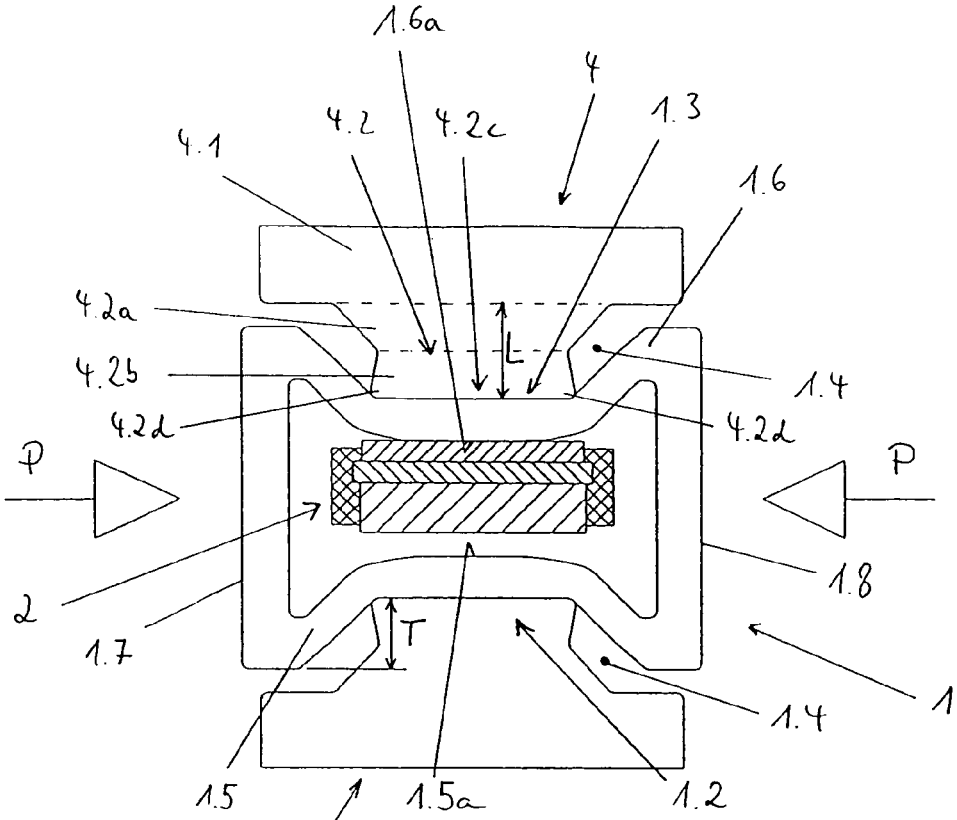
FIG. 3*a* A profile tube according to the invention with fitted PTC element and attachment parts prior to pressing.

FIG. 3*a, b* show in detail the aforementioned pressing process by the pressurization (arrow P) of side walls 1.7, 1.8 of the inventive profile tube 1. According to FIG. 3*a, b* the latter is constructed substantially as explained relative to FIG. 1, but does not have ribbed elements. In the free spaces 1.4 (cf. FIG. 1) formed in the vicinity of the drawn in, concave top wall areas 1.2, 1.3, in FIG. 3*a, b* use is in each case made of attachment parts 4 in the form of flat metal lamellas. Starting from a main body 4.1, the latter have an end area in the form of a projection 4.2, which initially tapers conically in a first area 4.2*a* connecting on to the main body 4.1 and then slightly conically widens in a second area 4.2*b*, so that in the vicinity of a tip 4.2*c* of projection 4.2 angles 4.2*d* are formed. A length L of the projection 4.2 is greater than the drawing in or retraction depth T of the top wall areas 1.2, 1.3, so that the attachment part 4 with its projection 4.2 can be brought into the free space area 1.4, the tip 4.2*c* in each Case contacting the side wall 1.5, 1.6, without the main body 4.1 of the attachment part 4 engaging with the side walls 1.5, 1.6 of profile tube 1.

Figure 3B:
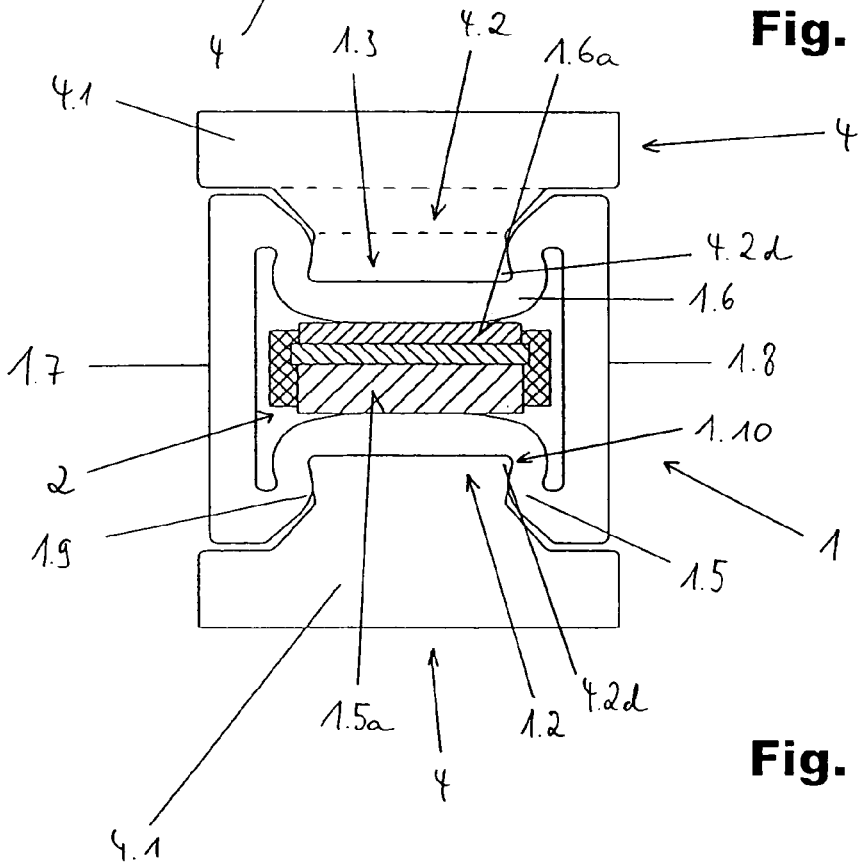
FIG. 3*b* A profile tube according to FIG. 3*a*, after pressing.

FIG. 3*b* again shows the arrangement of FIG. 3*a* after pressurization P. The pressing pressure P firstly leads to the pressurized side walls 1.7, 1.8 moving towards one another, accompanied by a reduction of their spacing b (FIG. 1). Initially as a result of the inwardly directed forces acting in the top walls 1.5, 1.6, the entry into the top wall areas 1.2, 1.3 increases to a=a' (FIG. 1), so that the PTC element 2 is clamped and braced via its flat sides 2*a*, 2*b* between top walls 1.5, 1.6 in the interior 1.1 of profile tube 1. The top walls are slightly convexly shaped on their insides 1.5*a*, 1.6*a* (cf. FIG. 1, 3*a*) for bringing about a maximum contact surface with the PTC clement 2 for heat transfer purposes. Simultaneously, in the drawn in, concave top wall areas 1.2, 1.3 bulges 1.9 of the top walls 1.5, 1.6 are formed, so that the previously trapezoidal, free space area 1-4 (cf. FIG. 1, 3*a*) now has undercut 1.10. This leads to a positive engagement of the attachment part 4, shown in FIG. 3*b*, in the vicinity of the projection 4.2 (angles 4.2*d*) and the bulges 1.9 and undercuts 1.10 in the top wall areas 1.2, 1.3, so that the attachment part 4 is held in clamping manner on profile tube 1. The slightly S-shaped configuration of the top walls 1.5, 1.6 in the vicinity of the bulge 1.9 and undercut 1.10 visible in FIG. 3*b*, as a result of a certain spring action, also allows a compensation of height difference and/or tolerances of both the PTC element 2 and the profile tube 1.

As a result of the preshaped retraction of the top walls 1.5, 1.6 of profile tube 1 shown in FIG. 1, 2*b*, 3*a*, compared with known methods, the invention makes it possible to use a significantly reduced pressure P in order to produce the connection shown in FIG. 3*b* between the attachment parts 4 and the profile tube 1. In addition, the bracing of the PTC elements 2 and the fitting of the attachment parts 4 take place in the same operation. The aforementioned s-shaped configuration of the top walls 1.5, 1.6, following pressurization P, also ensures that the inventive profile tube 1, after pressurization P has taken place, i.e. after removing a corresponding, not shown pressing tool, cannot automatically open again (self-locking) due to tension stored in the material. This reliably avoids the previously listed disadvantages of corresponding, known methods and devices.

Figure 4A:
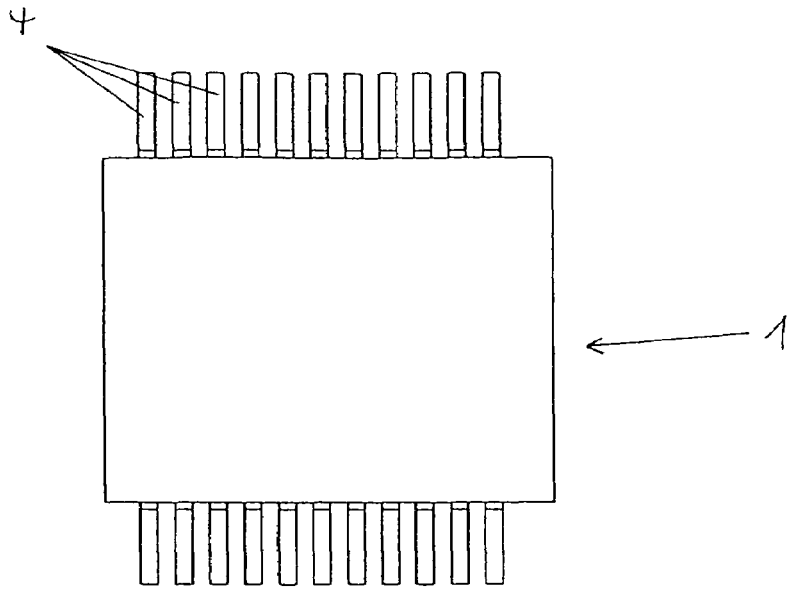
FIG. 4*a* A side view of the inventive profile tube of FIG. 3*b*.
Figure 4B:
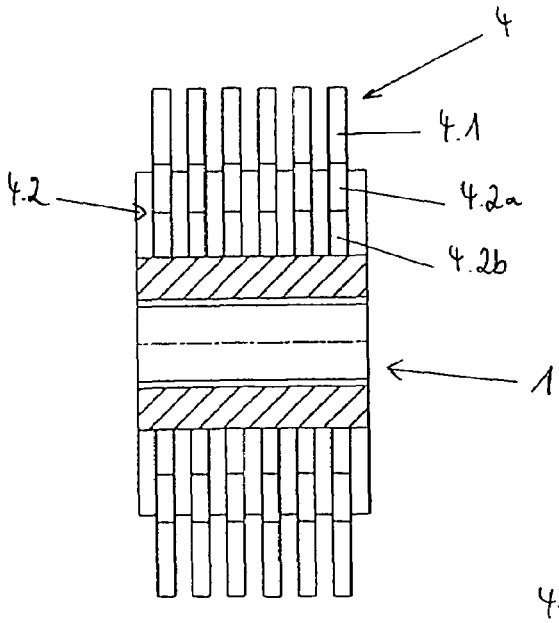
FIG. 4*b, c* Longitudinal sections through alternative developments of an inventive profile tube according to FIG. 3*b*.
Figure 4C:
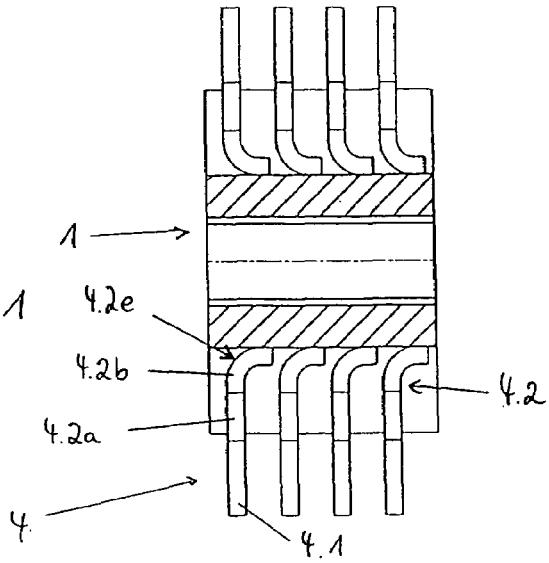

FIG. 4*a* is a side view of the inventive profile tube 1 according to FIG. 3*a, b* with a plurality of in each case parallel oriented attachment parts 4 in the form of metal lamellas. FIG. 4*b, c* are sections through a profile tube-lamella arrangement according to FIG. 4*a*. The developments according to FIG. 4*b* and 4*c* differ in that the attachment parts in the outer area 4.2*b* of protection 4.2 shown in FIG. 4*c* have a substantially right-angled bend 4.2*c*, as a result of which there is an improvement to the heat conducting contact between the attachment parts 4 and profile tube 1.

Figure 5A:
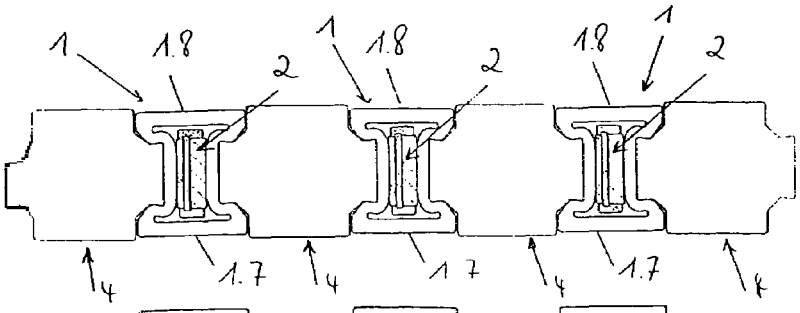
FIG. 5*a* A cross-section through a heater constructed using profile tubes according to the invention.
Figure 5B:
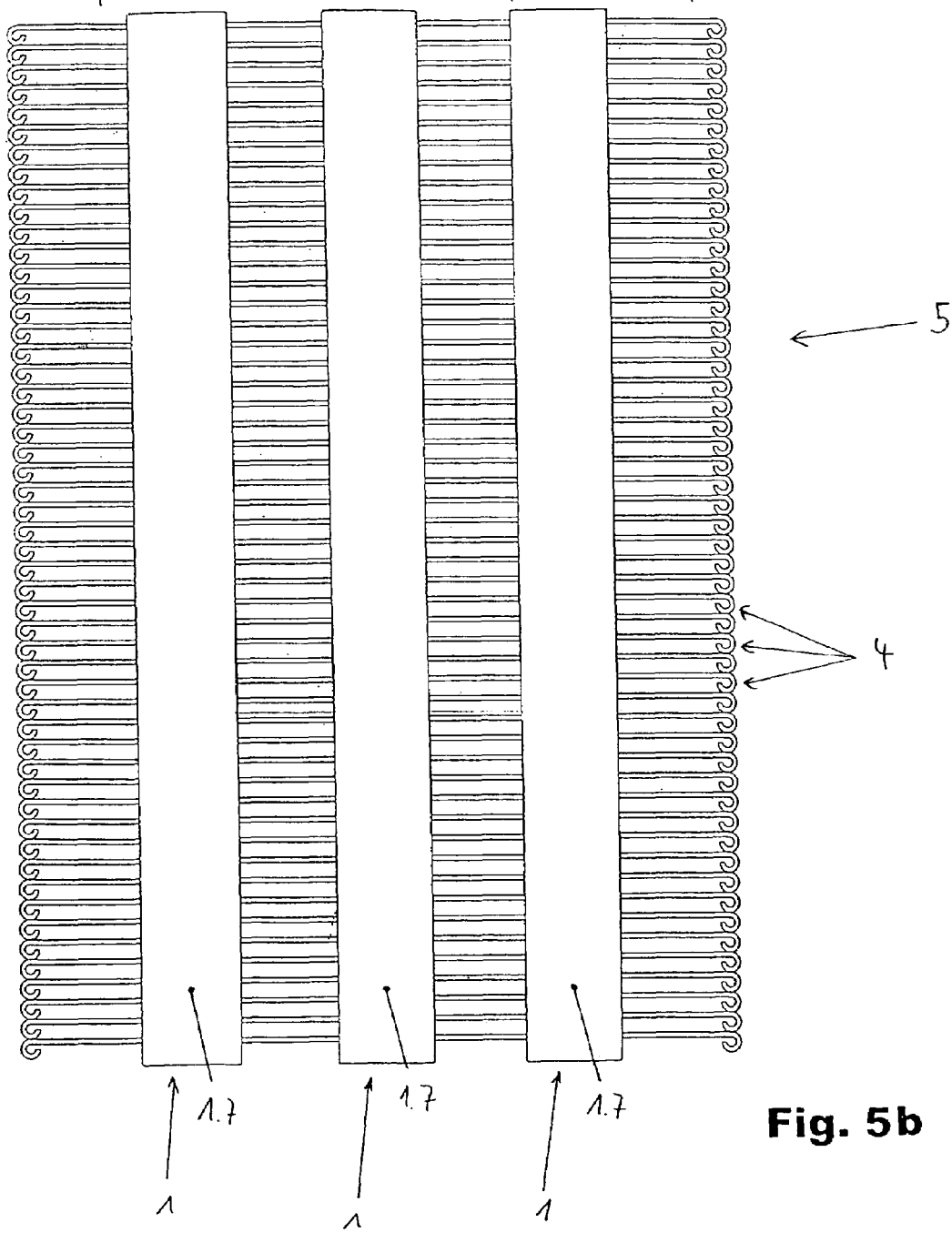
FIG. 5*b* A side view of the heater of FIG. 5*a*.

FIG. 5*a, b* shows how a plurality of inventive profile tubes 1 with inserted PTC elements 2 con be connected by means of an arrangement of attachment parts 4 to form an assembled device, in the embodiment shown specifically a heater 5. The overall structure of the heater 5 shown in FIG. 5*a, b* can be assembled beforehand and held in unbraced manner by means of a suitable, not shown holding tool. Subsequently the overall heater 5 is braced by pressurizing the side walls 1.7, 1.8 of profile tubes 1 on a single operation, as is illustrated by FIG. 1, 2*b*, 3*a*.

Figure 6A:
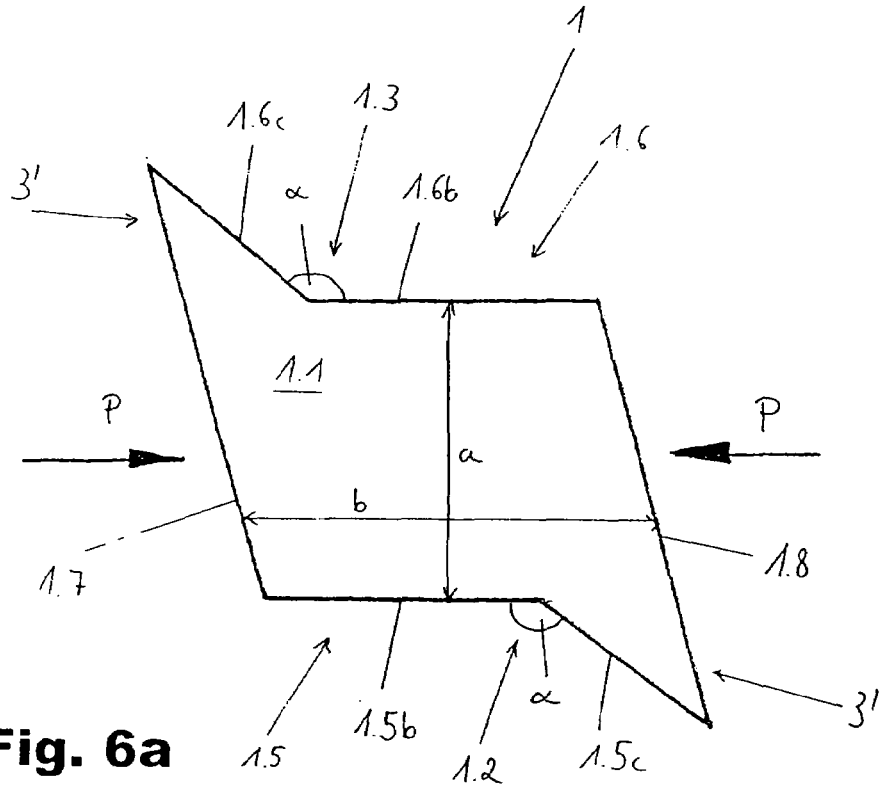
FIG. 6*a, b* Another possible cross-section of an inventive profile tube before and after pressing.

Finally, FIG. 6*a, b* show a further development of the inventive profile tube 1 before and after pressing (pressurization P; FIG. 6*a*). The concave construction of the top walls 1.5, 1.6 results from a cross-sectionally two-legged structure with legs 1.5*b*, 1.5*e* and 1.6*b*, 1.6*c*, which prior to pressing form an obtuse angle α. The side walls 1.7, 1.8 and the legs 1.5*b*, 1.6*b* are arranged pairwise in a small obtuse angle to one another. Thus, the side walls 1.7, 1.8 and the legs 1.5*c*, 1.6*c* form tooth-like projections 3' (FIG. 6*a*).

Figure 6B:
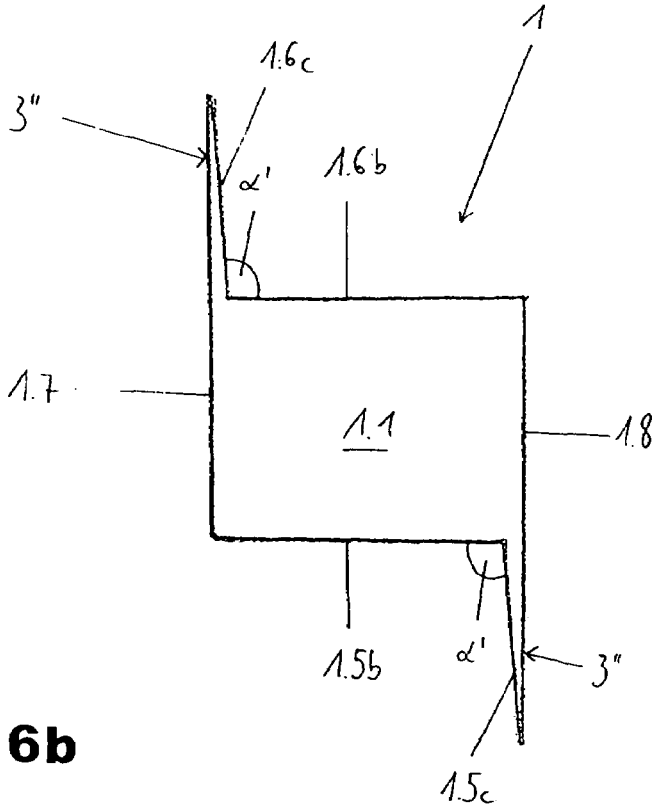

In the case of lateral Pressurization, accompanied by a reduction of the angle α ((FIG. 6*a*) to approximately 90° (angle α'; FIG. 6*b*), the legs 1.5*c*, 1.6*c* engage on the side walls 1.7, 1.8 and once again there is a decrease in the internal spacings between the side walls 1.7, 1.8 and between the top walls 1.5, 1.6 or their legs 1.5*b*, 1.6*b*, so that inventive, not shown functional elements can be braced in the interior 1.1 of the profile tube 1. The projection 3" of FIG. 6*b*, resulting from the projections 3' of FIG. 6*a*, can be looked upon and used as ribbed elements (of. reference numeral 3 in FIG. 1).

The invention claimed is:

1. Method for bracing functional elements, comprising providing at least one functional element, the at least one functional element comprising at least one PTC heating element having opposed first and second major surfaces, in a hollow reception means, the hollow reception means comprising a profile tube having two opposed at least partly concave wall areas facing one another and facing the opposed first and second major surfaces of the at least one functional element and having opposed side walls extending substantially perpendicular to the opposed concave wall areas, and bracing the at least one functional element by pressurizing the opposed side walls of the hollow reception means substantially in the direction of their surface normal.

2. Method according to claim 1, wherein as a result of pressurizing the opposed side walls an internal spacing of the side walls is reduced and pressurization takes place thereon, regions of the concave walls areas approaching one another for clamping the at least one functional element.

3. Method according to claim 1, wherein as a result of pressurizing the opposed side walls, a spacing between portions of at least one of the concave wall areas is reduced and between them is permanently clamped at least one attachment part.

4. Tube for receiving functional elements, comprising two opposing at least partly concave wall areas facing one another and arranged so as to face opposed major surfaces of at least one functional element, the at least one functional element comprising at least one PTC heating element, when the at least one functional element is provided in the tube, and side walls extending substantially perpendicular to the concave wall areas, wherein the two opposing at least partly concave wall areas and the side walls are constructed such that the side walls can be pressurized with a pressing pressure substantially in the direction of their surface normal for reducing an internal spacing between the concave wall areas.

5. Tube according to claim 4, wherein, prior to being pressurized, an outwardly widening, free space area with a cross-section substantially corresponding to an isosceles trapezium is defined outside each of the two opposing at least partly concave wall areas.

6. Tube according to claim 5, wherein the free space area is constructed for receiving at least one complimentary end area of an attachment part.

7. Tube according to claim 6, wherein the tube is constructed so that portions of outer surfaces of each of the two opposing at least partly concave wall areas substantially positively embrace end areas of the attachment part following pressurization, so that it is retained in clamping manner.

8. Tube according to claim 6, wherein the tube is constructed so that portions of outer surfaces of each of the two opposing at least partly concave wall areas, after pressurization, define undercuts for resting complimentary areas of the attachment part.

9. Tube according to claim 4, wherein the two opposing at least partly concave wall areas and/or the side walls have ribbed elements.

10. Tube according to claim 9, wherein the ribbed elements have an extension component in the longitudinal direction of the tube.

11. Tube according to claim 9, wherein in cross-section the ribbed elements have an extension substantially perpendicular to a local path of the two opposing at least partly concave wall areas and/or the side walls.

12. Method for creating an assembled device, comprising linking a plurality of tubes according to claim 4 with attachment parts, the attachment parts being held by the tubes.

13. Heater comprising the tube according to claim 6 with an arrangement of emission ribs as the attachment part.

14. Heater with an arrangement of heat emission ribs, wherein are provided a plurality of tubes according to claim 4.

15. Method according to claim 1, wherein the at least one functional element comprises a plurality of PTC heating elements.

16. Method according to claim 15, wherein each of the plurality of PTC heating elements comprises a resistor as one of the opposed major surfaces, an insulating member as another of the opposed major surfaces and a contact frame on side surfaces thereof.

17. Tube according to claim 4, wherein the at least one functional element comprises a plurality of PTC heating elements.

18. Tube according to claim 17, wherein each of the plurality of PTC heating elements comprises a resistor as one of the opposed major surfaces, an insulating member as another of the opposed major surfaces and a contact frame on side surfaces thereof.

* * * * *